United States Patent [19]

Frazier

[11] Patent Number: 4,937,910

[45] Date of Patent: Jul. 3, 1990

[54] WHITE BOARD ERASER

[76] Inventor: Thomas G. Frazier, c/o J. Penner Corp., Waterside Industrial Park, Box B113, R.D. #2, New Hope, Pa. 18938

[21] Appl. No.: 277,764

[22] Filed: Nov. 30, 1988

[51] Int. Cl.[5] ..... A47L 13/00

[52] U.S. Cl. ..... 15/231; 15/230.17; 51/391; 51/401; 51/406; 51/407

[58] Field of Search ..... 15/231, 232, 230.17; 51/391, 394, 401, 406, 407

[56] References Cited

U.S. PATENT DOCUMENTS

| | | | |
|---|---|---|---|
| 466,337 | 1/1892 | Fries | 15/231 |
| 2,301,505 | 11/1942 | Bates | 15/231 |
| 2,414,872 | 1/1947 | Harter | 15/231 |
| 2,693,610 | 11/1954 | Hensley | 15/231 X |
| 2,739,334 | 3/1956 | Hardey | 15/231 |
| 2,756,549 | 7/1956 | Macullar | 51/391 |
| 2,870,475 | 1/1959 | Scheuer et al. | 15/231 |
| 3,199,136 | 8/1965 | George | 15/231 |
| 3,376,595 | 4/1968 | Cole | 15/231 X |

FOREIGN PATENT DOCUMENTS

| | | | |
|---|---|---|---|
| 459921 | 1/1937 | United Kingdom | 15/231 |

*Primary Examiner*—Chris K. Moore
*Attorney, Agent, or Firm*—Z. T. Wobensmith, III

[57] ABSTRACT

An eraser for removal of dry ink dust and for conditioning of white boards is provided which includes a stack of fabric layers of semi rectangular shape which are fastened to a jacket cover, which is folded over a central core, the fabric layers having tab dispensing ends and other tab ends fastened to the cover, which layers can be removed one at a time. The fabric layers may be treated with cleaning and anti-static compounds.

18 Claims, 4 Drawing Sheets

WHITE BOARD ERASER

BACKGROUND OF THE INVENTION

1. Field of the Invention

This invention relates to an eraser of the type that is particularly designed to remove ink from white marker boards.

2. Description of the Prior Art

A white marker board (or light shades of tan) is generally a vertically mounted writing surface, that is written upon with felt-tipped pens, and that dispense a contrasting color ink that "dries" on the board. The writing is of a non-permanent ink which when "erased" becomes a loose dust that is removed from the board with the use of an eraser.

Typically, a white board is erased with a traditional felt type eraser, which was originally designed for use on black slate boards. The use of such a traditional felt (or foam type) eraser designed for slate blackboards, presents many problems for white board use. There are several reasons for the problems. A felt eraser is intended to remove white chalk dust from the porous surface of a slate board. Excess chalk dust, not held by an eraser, drops to the chalk tray, leaving the blackboard a dark shade of gray, but sufficiently dark to contrast with newly applied white chalk. The chalk dust drops from the board to the chalk tray, or is picked up by a clean felt eraser, since no static charges are generated during this procedure.

Additionally, the felt eraser re-fills pores in the slate board with chalk dust during the erasing operation, providing the user with a "chalked-in" board at all times. (Note that a brand new blackboard must be "chalked in" to prevent permanent "ghosts" that would occur if it were immediately written upon with chalk.)

A new white board, on the other hand, has a totally non-porous finish. The white board surface is normally porcelain, melamine, (resin finish) or plastic (polyester, etc.). Erasing marker dust from a white marker board using a "standard felt eraser" can and does cause static charges to build up through triboelectric forces, particularly on melamine and plastic surfaces. As the marker dust is not as dense as chalk dust, it does not drop off white boards, but has a tendency to adhere to the board's surface. This clinging problem is especially prevalent when static charges are generated. When the felt eraser becomes "saturated" with synthetic light, marker board ink dust, it redeposits, or pushes the dry ink to other portions of the white board. This condition makes the white board irregularly blotchy with dust, and very difficult to read, as well as unattractive.

A white board, after being subjected to the chemical solvents present in most of the marker pen inks and various types of chemical cleaners used to clean the board, gradually goes from a non-porous glazed surface (when new) to a more open porous surface. This condition is similar to a porcelain sink that has been scoured too often and from which the porcelain glaze has been removed. This treatment leads to a condition known in the industry as "ghosting". Ghosting occurs as marker pen ink flows down into the porous surface and dries. When a white board surface has been ghosted, only the top dust is removed when it is conventionally erased. The dried ink trapped below the surface remains there, creating "ghosts" of previous writings.

The ideal white board eraser should address the problems of ghosting caused by worn/porous white board surfaces.

Finally the ideal white board eraser should be easy to use, easy to clean, capable of renewing its dust holding ability; and comfortable to hold. Ideally it should be sized no larger than a standard eraser (2"×5"×1.5" typically), as it must fit on the small trays provided on most white boards. Such an eraser ideally would be disposable after a life of 10–20 times that of a standard felt eraser, that was properly cleaned 10–20 times.

There have been many attempts to solve each of these concerns for the ideal eraser, but none of them has proven satisfactory by themselves and certainly not in concert with one another.

The Green U.S. Pat. No. 1,852,114 discloses a renewable surface dust cloth, that is composed of a plurality of thin, fibrous, loosely compacted layers.

While Green addresses the need for a "loose nap" material to increase dust holding capacity, the paper wadding structure disclosed is too weak to function as an eraser surface on a white board for any substantial time. While Green mentions impregnation of his dust cloth with an oil to increase its dust holding capacity, Green does not provide the convenience and hygienic factor of keeping the user's hand from touching a partially used surface, or one that contains an oil conditioner. Green provides no handle, no easy storage arrangement of holding, and then of discarding a layer of fabric after use, without handling the soiled layers.

The Harter U.S. Pat. No. 2,414,872, discloses a blackboard cleaner which includes a handle to which a laminated pad is mounted. The pad includes a number of plies or sheets of fabric that have been impregnated with a chemical to facilitate cleaning and prevent chalk dust.

The plies or sheets that make up the pad are vertically stitched to a tape, so that side portions of the sheets can be folded to bring surfaces of the plies to the front for use.

While Harter provides a more durable erasing surface, it would be necessary to clean the plies to obtain any reasonable economic life of the device. The Harter handle would not be satisfactory for white board use as it is cumbersome, and upon lifting, the soiled layers would likely revert to the original configuration and contact by the user would be necessary to expose a clean surface.

The Nebelung U.S. Pat. No. 1,587,670, discloses a device for polishing shoes and other articles, which includes a block carrying an endless band of fabric, the soiled surface of which must be handled to bring a fresh surface into use. The life of the Nebelung device is very limited, and requires excessive exposure of the soiled surface to the user's hands, as well as inconvenience due to the necessity of indexing or refilling the endless loop.

The Darling U.S. Pat. No. 2,648,863 discloses a blackboard eraser that is a hand held device, including a handle carrying a pad of material, but does not provide any structure to conveniently remove a soiled sheet of material without touching the soiled surface. Additionally, multiple layers (i.e., 10–20) of material could not be held by the holding tabs which Darling describes.

The Brouty U.S. Pat. No. 2,465,194, Walkama, No. 2,702,913, and Oviatt, No. 3,613,146, disclose various attempts to increase the dust holding or carrying capacity of a hand held device by providing a roll of material in the handle area. The use of a roll of material becomes unsatisfactory for white board eraser use when the bulk of such a device is considered.

The Bergquist U.S. Pat. No. 2,708,761, Walkama, No. 2,702,913 and Hensley, No. 2,693,610, disclose the use of adhesives to hold together adjacent layers of material. Adhesively held layers of material are susceptible to many shortcomings. The leading edges of the material tend to roll up due to friction, exposing the adhesive layer to the surface to be cleaned. Adhesive transferred to the board would reduce its use as a writing surface, and would also trap loose marker board dust. Renegade adhesive could also be retained on newly presented layers resulting in the described conditions.

Another commercially available white board eraser holds 25 replacement tissues, and is offered by Schwan Stabilo U.S.A., Inc. The used tissues are not easily disposed of as the user must handle the remaining stack of replacement tissues each time they are changed, which requires dismantling the eraser's components. If these tissues were to incorporate a conditioning and anti-static treatment (which they do not), handling them would be very messy and inconvenient, since to change a surface, the entire device must be "disassembled". This device lacks holding ability, as the spongy foam pad held by the handle fails to keep the fabric layer taut, so that the exposed fabric layer easily becomes loose, develops creases and folds during use. Schwan also requires that it be reloaded with replacement tissues to make it economical for use.

The eraser of my invention does not have the shortcomings of the prior art and provides many positive advantages.

SUMMARY OF THE INVENTION

In accordance with the invention, a white board eraser is provided for removal of ink dust from a white board, and conditioning of the board surface to prevent static charge build up, and to fill up the pores of the surface, providing an improved writing surface.

The principal object of the invention is to provide a white board eraser that simultaneously removes ink dust and conditions the surface of the board.

A further object of the invention is to provide a white board eraser that provides a plurality of readily renewable surfaces for board contact.

A further object of the invention is to provide a white board eraser that has greater dust holding power than previously available like erasers.

A further object of the invention is to provide a white board eraser that is simple to construct but sturdy and long lasting in use.

A further object of the invention is to provide a white board eraser that is economical and which can be used without the user contacting soiled eraser surfaces.

A further object of the invention is to provide a white board eraser that both conditions and coats the board surface with an anti-static material.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
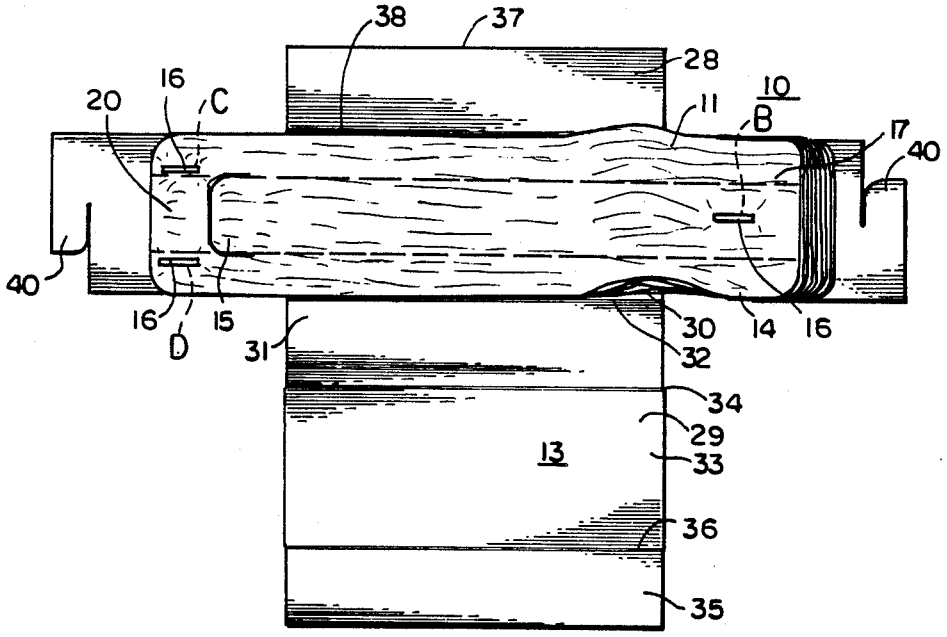
FIG. 1 is a top plan view of the white board eraser prior to assembly.

It should, of course, be understood that the description and drawings herein are illustrative merely, and that various modifications and changes can be made in the structures disclosed without departing from the spirit of the invention.

DESCRIPTION OF THE PREFERRED EMBODIMENTS

Referring now more particularly to the drawings and FIGS. 1–7 inclusive a preferred embodiment of the white board eraser 10 is shown which includes a multi-layered fabric stack 11, a rigid foam core 12 and a jacket cover 13.

More specifically, the multiple layer fabric stack 11 is a die cut stack of nonwoven fabric layers 14, which fabric layers 14 at least has the following characteristics: a carded nonwoven construction, with machine direction tensile strength exceeding cross machine direction tensile strength by a factor of 2 to 1 (typical minimum). The nonwoven fabric layers 14 are print bonded in an "open" design, such as an array of binder dots or in a diamond pattern. The open pattern design allows for a higher dust capacity in the nonwoven fabric, as the unbonded areas are 100% fiber. Since fibers hold dust; the more open the pattern, the higher the dust holding capacity of the fabric layer 14. Additionally, the nonwoven fabric layers 14 are oriented with the machine direction of the fabric (or the direction with the higher tensile strength) in the same direction as the long axis of the eraser.

The fabric layer 14 should preferably be impregnated with a organosilicone fluid, such as Polyalkyleneoxide modified polydimethylsiloxane, available from Union Carbide, to approximately 20% by weight of the base fabric. While mineral oil (or other dust holding additives not in the oil family) may be used, the use of an organosilicone fluid based additive achieves both increased dust holding ability, and antistatic properties. While other percentages can be used, it has been found that an additive level of 20±5% by weight achieves ideal conditions for the eraser fabric. The preferred fluid not only acts as a dust magnetic in the unbonded sections of the fabric, but in the case of organosilicone fluid, it additionally acts as an antistatic agent during the erasing procedure, which is especially true when used on a synthetic (melamine or polyester) white board surface.

The stack 11 typically contains ten to twenty fabric layers with a typical thickness of 150″–¼″, which layers 14 are die cut so as to expose a series of layered pull tabs 15 when the base 11 is fastened, such as by staples 16, to the jacket cover 13 or directly to the partially assembled jacket/core assembly.

The technique used to staple and the locations thereof (or other means of fastening) is important to the product's proper use. The layers 14 of fabric must be shingled or layered at point B on end 17 to provide uniform tension, and to eliminate wrinkles and loose layers in the "bottom" portion 18 of the layers 14.

It should be noted that the layers 14 of the fabric are attached to the cover 13 at least three points B, C and D when the preferred embodiment is used. Points B, C and D are located to allow the dispensing of one layer of fabric at a time without disturbance of the remaining layers 14.

Figure 2:
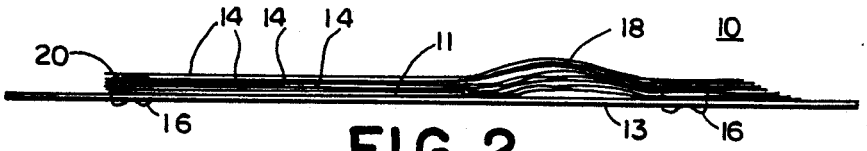
FIG. 2 is a side elevational view of the eraser of FIG. 1.
Figure 3:
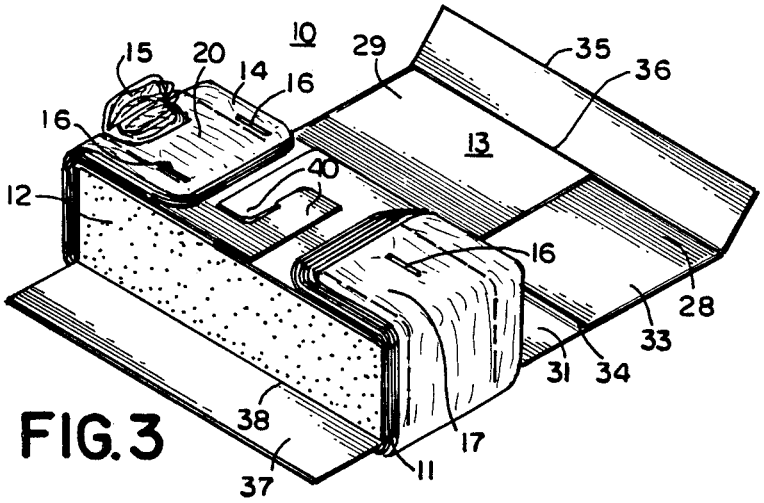
FIG. 3 is a view in perspective of the eraser of FIG. 1 in partially assembled condition.
Figure 4:
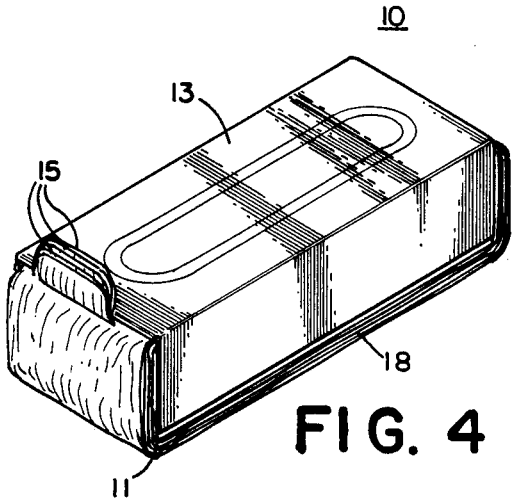
FIG. 4 is a view in perspective of the eraser of FIG. 1 in assembled condition.

The method of fastening is important as each layer 14 of the fabric must be held taut during the eraser's useful life, but easily allow the exposed layer to be removed without disturbing or loosening the remaining layers 14. One preferred technique (although other techniques can be used) to achieve this is to staple the layers 14 at the 3 points B C, and D with a staple 16 such as a clinch of well known type so as to provide a "wicket" type hold on the fabric, as shown in FIG. 2, and not a pressure or compression type hold. Additionally, it should be noted that the orientation of the staples 16 is important to achieve the above described conditions. The staples 16 (or other type fastener) should ideally be oriented in the long axis of the eraser 10, as shown. When properly oriented, the staples 16 present the least parting force when a single layer is removed, which results in easy removal of the exposed layer 14, but provides sufficient holding strength for the remaining layers 14.

Figure 5:
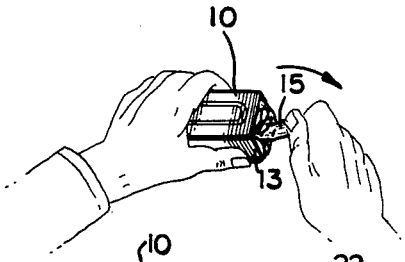
FIG. 5 is a schematic view of an eraser of the invention illustrating the first step in removing a layer of fabric to provide a new surface.
Figure 6:
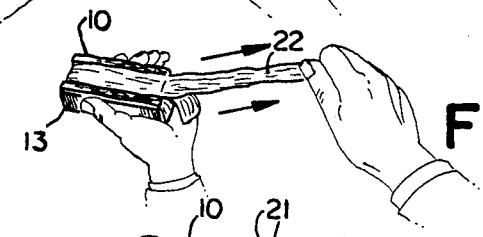
FIG. 6 is a view similar to FIG. 5 illustrating the second step.
Figure 7:
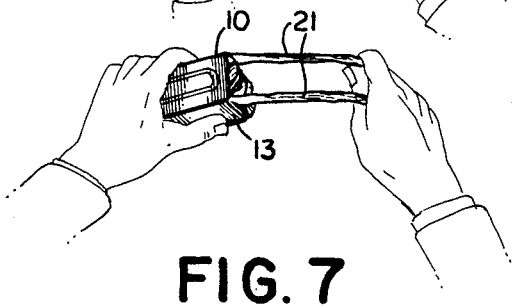
FIG. 7 is a view similar to FIG. 5 illustrating the third step to providing a new surface.

The location of the staples 16 is critical. At least two fasteners 16 are required at the tab end 20 of the fabric stack 11 immediately outside the tab area, and none within the tab area at this end. The tab area is defined by two parallel lines that are parallel to the long axis of the eraser, one on each side of the dispensing tab. At least one fastener 16 at the other end 17 of the stack 11 is required that is both within the tab area, and as close as possible to the end of the layered ends 17, while still holding all layers 14 of fabric securely in place. This configuration allows the tab 15 as shown in FIGS. 5, 6 and 7, to zipper a central strip 22 down the used outside fabric and easily pull free from the layered end 17, exposing a clean portion 14 of soiled fabric layer from that end, that provides a clean end "tab" to pull the remaining outside strips 21 free from the tab end of the device. (See FIG. 7)

By using a nonwoven fabric with the described characteristics (MD tensiles greater than CD tensiles), the tab 21 will unzip the exposed layer 14 (See FIGS. 5, 6 and 7) so that with a minimum of time and effort, the soiled top layer is removed by touching only the clean tab, and a small portion of the exposed layer 14 that is also clean. Thus a soiled layer 14 is easily and cleanly removed, exposing a new layer surface with a minimum amount of time and effort.

The jacket cover 13 is intended to have an oil resistant finish 28 of well known type, on the interior 29, of the printed cover 13, to prevent oil from migrating to the cover surface, and contaminating the user's hand with oil, or distorting the printed graphics on the product's cover. This can also be achieved by fabricating the cover of light weight, oil impervious, plastic sheeting, such as PVC, or Polypropylene.

The jacket cover as illustrated in FIG. 1 is a blank of semi-rectangular form which includes a central panel 30 aside cover panel 31 connected to panel 30 along fold line 32, a top cover panel 33 connected to panel 31 along fold line 34, and a side cover panel 35 connected to panel 33 along fold line 36. A side cover panel 37 is provided connected to panel 30 along fold line 38 and which is intended to engage core 12 and to which panel 35 is secured such as by adhesive of well known type.

The central panel 30 has side cover panels 40 and 41 connected thereto along fold lines (not shown) and which each includes self-clinching tabs, known in the industry as Arthur Locks 40 which facilitates the assembly of the eraser 10.

Figure 8:
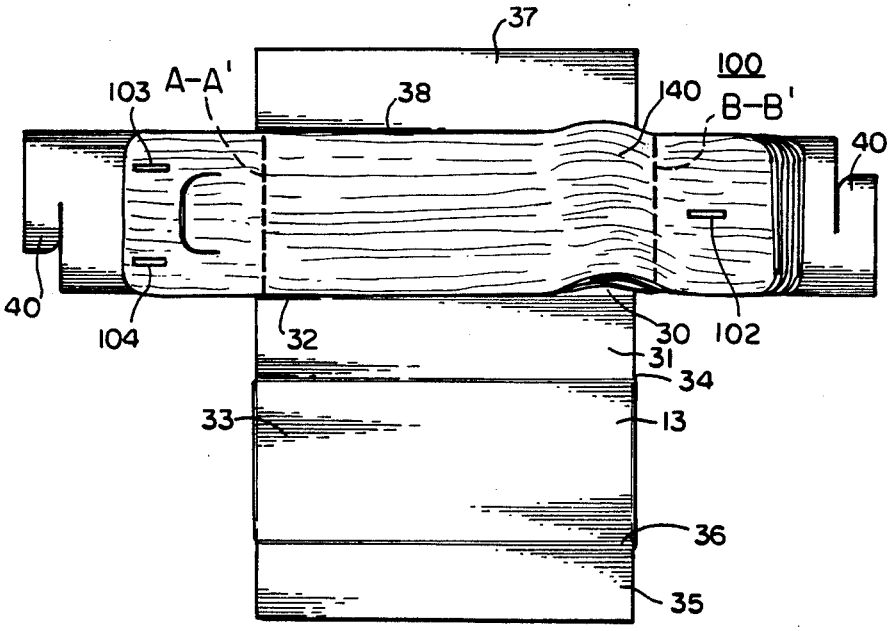
FIG. 8 is a top plan view similar to FIG. 1 but illustrating another embodiment of eraser of the invention.
Figure 9:
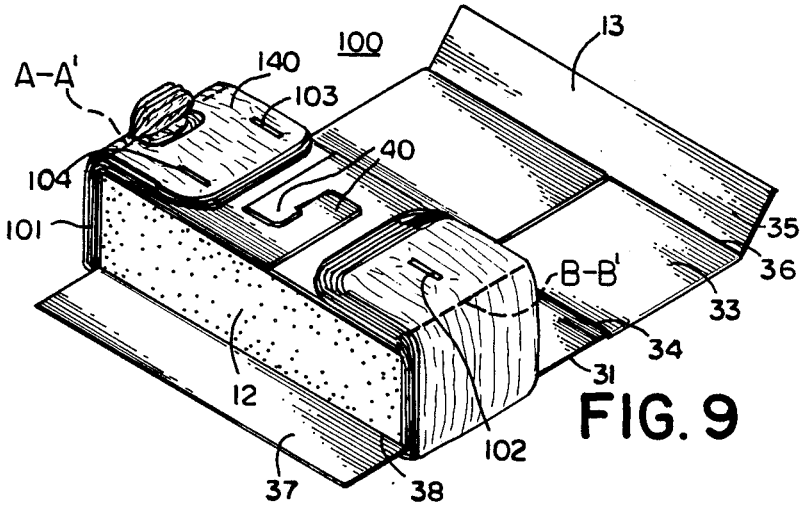
FIG. 9 is a perspective view of the eraser of FIG. 8.

Referring now to FIGS. 8-9 another embodiment of the invention 100 is illustrated wherein the chosen fabric used as the cleaning surface (such as wet-formed nonwovens, fiber reinforced papers) is more balanced in machine and cross machine direction tensile strengths (i.e., MD tensile strength is less than or equal to CD tensile strength). A variation in the method of construction is therefore required to achieve self-dispensing of used layers 140 to expose a "new" layer surface.

In this embodiment the stack of die cut fabric 101 is perforated along lines A—A' and B—B'. While this embodiment of the invention is necessary for certain types of nonwovens or paper fabric mentioned above (i.e., sand papers) it requires the necessary additional step of perforating the stack of material along the A—A' and B—B' lines.

It is also noted that when using this embodiment of the invention, the location and number of the fastening points 102, 103, and 104 is not as critical as in the embodiment of FIGS. 1-7. These points may be conveniently located anywhere behind (toward the center of the eraser) lines A—A' and B—B' and they may be as few as one at each end, or two or more at each end.

It should be noted that other types of nonwoven fabrics, such as bonded webs, binderless hydrowoven fabrics,. needle punched nonwoven fabric and even woven fabric having similar physical characteristics, with napped surfaces for dust holding capacity, may be used. The fabric must be structurely designed to allow the "zipper" effect of dispensing one layer at a time. In some instances, the fabric may have to be pre-perforated along two lines immediately outside the dispensing tab in the long axis of the eraser (C—C' and D—D') such as shown in FIG. 10 to achieve this zippering effect.

Figure 10:
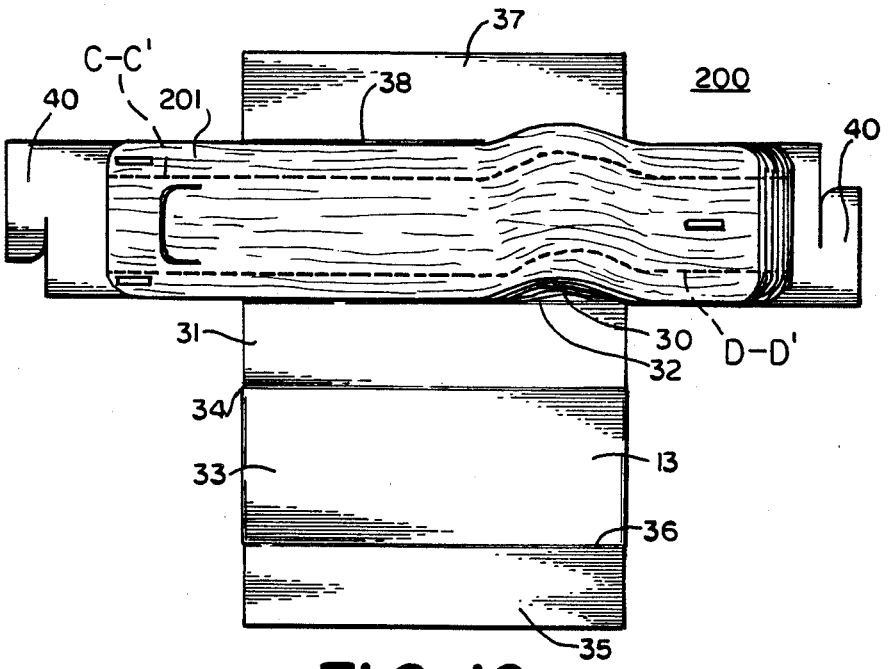
FIG. 10 is a bottom plan view of still another embodiment of the eraser of the invention.

Referring now more particularly to FIG. 10 another embodiment of the invention 200 is illustrated wherein the stack of fabric 201 is perforated on lines C—C', D—D' on the long axis of the fabric, which perforations are necessary to accommodate certain types of fabrics.

Other embodiments of the invention may be considered. The device can be used as a shoe shine buffer for example. The layers of material may be impregnated with a shoe polish, or alternately every other layer with polish, and with the intermittent layer being a buffing cloth, free of wax polish.

Still another embodiment of the invention, would be use as a sand paper block with self-dispensing layers, proceeding from an outside layer (coarse) to inside layers less coarse to final layers of fine paper.

It will thus be seen that devices have been described with which the objects of the invention have been achieved.

I claim:

1. An eraser for white board surfaces which comprises a stack of elongated fabric layers, a jacket cover, a rigid central core about which said stack and said cover are wrapped, fastening means to detachably fasten said fabric layers at each end to said jacket cover such that said layers can be removed one at a time without disturbing the underlying layers, and each of said fabric layers having an exposed dispensing pull tab at one end for removal of one layer at a time from said stack.

2. An eraser as described in claim 1 wherein said fabric layers are treated with a material to improve dust holding ability.

3. An eraser as described in claim 2 wherein said cover is of chemical resistant material.

4. An eraser as described in claim 1 wherein said fabric layers are treated with an antistatic agent.

5. An eraser as described in claim 3 wherein said antistatic agent is an organisilicone fluid.

6. An eraser as described in claim 1 in which said layers of fabric are composed of bicomponent fibers that generate no static charges when subjected to triboelectric forces.

7. An eraser as described in claim 1 in which said layers of fabric are constructed of carded nonwoven fabric.

8. An eraser as defined in claim 1 in which said layers of fabric are constructed of printed bonded nonwoven fabric with the highest directional strength of the fabric in the longitudinal axis of the layers.

9. An eraser as described in claim 1 wherein the fabric layers are perforated at both ends of the eraser perpendicularly to the longitudinal axis of the layer and eraser, and across the width of the fabric.

10. An eraser as described in claim 1 wherein the fabric layers are layered or shingled at at least one end prior to fastening to the cover.

11. A device as described in claim 1 wherein said fabric layers are treated with mineral oil.

12. An eraser as described in claim 1 in which said layers are provided with a tab area which is defined by two parallel lines extending along the longitudinal axis of the layers one on each side of the dispensing pull tab, said fastening means are at least three staples, the axis of which are oriented in the longitudinal axis of the fabric layers, and at least two of said staples are located outside the dispensing pull tab at one end, and one staple is located within the tab area at the other end.

13. An eraser as described in claim 12 wherein the staples are clinched so that they do not compress or exert significant downward pressure on the fabric stack.

14. An eraser as described in claim 1 wherein said fastening means includes two fastening points at said pull tab end and at least one fastening point at the other end, said layers of fabric are perforated along the longitudinal axis of the device following two parallel lines, each immediately outside the dispensing pull tab, but inside of the two fastening points at said pull tab end, and within the area of the fastening point(s) at the other end.

15. A device for providing layers of material for contact with a surface, one layer at a time which comprises:

a stack of die cut elongated layers of material, said stack providing a tab at one end of each layer, said stack having material layers shingled at at least one end, a jacket cover, a rigid rectangular solid core with straight sides about which said stack and said cover are wrapped, fastening means to detachably fasten said fabric layers, one at the tab end of the stack and one at the non tab end of the stack, such that said layers can be removed one at a time by using the exposed tab, without disturbing the underlying layers.

16. A device as described in claim 15 in which said layers of material are sand paper.

17. A device as defined in claim 15 in which said layers of material are impregnated with a polishing compound.

18. A device as defined in claim 15 in which said layers of material are impregnated with a cleaning compound.

* * * * *

UNITED STATES PATENT AND TRADEMARK OFFICE

CERTIFICATE OF CORRECTION

PATENT NO. : 4,937,910

DATED : July 3, 1990

INVENTOR(S) : THOMAS G. FRAZIER

It is certified that error appears in the above-identified patent and that said Letters Patent is hereby corrected as shown below:

Column 4,

Line 68, delete "150" and insert - 1/8" -

Signed and Sealed this

Eleventh Day of June, 1991

*Attest:*

HARRY F. MANBECK, JR.

*Attesting Officer*

*Commissioner of Patents and Trademarks*